US011612223B1

(12) United States Patent
Schermerhorn

(10) Patent No.: US 11,612,223 B1
(45) Date of Patent: Mar. 28, 2023

(54) BEACH UMBRELLA ASSEMBLY

(71) Applicant: William R. Schermerhorn, Colfax, NC (US)

(72) Inventor: William R. Schermerhorn, Colfax, NC (US)

( * ) Notice: Subject to any disclaimer, the term of this patent is extended or adjusted under 35 U.S.C. 154(b) by 0 days.

(21) Appl. No.: 16/859,131

(22) Filed: Apr. 27, 2020

Related U.S. Application Data

(60) Provisional application No. 62/870,085, filed on Jul. 3, 2019.

(51) Int. Cl.

| | |
|---|---|
| ***A45B 25/10*** | (2006.01) |
| ***A45B 11/00*** | (2006.01) |
| ***A45B 9/02*** | (2006.01) |
| ***A45B 25/02*** | (2006.01) |
| *A45B 23/00* | (2006.01) |
| *A45B 25/00* | (2006.01) |
| *G09F 17/00* | (2006.01) |

(52) U.S. Cl.
CPC ..... *A45B 11/00* (2013.01); *A45B 9/02* (2013.01); *A45B 25/02* (2013.01); *A45B 2023/0006* (2013.01); *A45B 2023/0018* (2013.01); *A45B 2025/003* (2013.01); *G09F 2017/0066* (2013.01)

(58) Field of Classification Search
CPC ..... A45B 25/10
See application file for complete search history.

(56) References Cited

U.S. PATENT DOCUMENTS

| | | | | | |
|---|---|---|---|---|---|
| 1,288,630 | A * | 12/1918 | Lyons | A45B 3/00 | 40/317 |
| 3,843,079 | A * | 10/1974 | Reisling | E04H 12/2238 | 248/530 |
| 4,505,285 | A * | 3/1985 | French | A45B 3/00 | 135/16 |
| 5,261,434 | A * | 11/1993 | Fodero | A45B 3/00 | 135/16 |
| 5,452,877 | A * | 9/1995 | Riffle | E04H 12/2246 | 248/511 |
| 5,758,678 | A * | 6/1998 | Wu | A45B 25/10 | 135/33.41 |
| 8,047,217 | B1 * | 11/2011 | Schermerhorn, Jr. | E04H 12/2215 | 135/118 |
| 10,765,186 | B2 * | 9/2020 | Letendre | A45B 25/10 | |
| 2013/0247435 | A1 * | 9/2013 | Bacik | A47C 4/00 | 40/606.03 |
| 2016/0227894 | A1 * | 8/2016 | Haythornthwaite | A45B 25/08 | |
| 2020/0018087 | A1 * | 1/2020 | Cowgill | A45B 25/10 | |

FOREIGN PATENT DOCUMENTS

| | | | | |
|---|---|---|---|---|
| DE | 3821285 | A1 * | 12/1989 | A45B 25/30 |
| GB | 2532474 | A * | 5/2016 | G09F 23/00 |

* cited by examiner

*Primary Examiner* — Noah Chandler Hawk
(74) *Attorney, Agent, or Firm* — MacCord Mason PLLC

(57) ABSTRACT

Umbrella devices, assemblies, and systems are shown and described. In one embodiment an umbrella assembly includes an umbrella having an aperture along a distal portion of a canopy, and a flagstaff to removably mate within the umbrella.

9 Claims, 12 Drawing Sheets

BEACH UMBRELLA ASSEMBLY

This application claims the benefit of U.S. provisional application No. 62/870,085, filed Jul. 3, 2019, which is incorporated herein by reference in its entirety.

FIELD OF THE TECHNOLOGY

The present inventions relate generally to umbrellas and, more particularly, to a system for docking a flagpole about an umbrella assembly.

BACKGROUND

Umbrellas have long provided enjoyment and relaxation on sunny days for those seeking shade to avoid uncomfortable overheating and/or sunburn. Traditionally, sun shading umbrellas have a centrally-disposed pole on which a collapsible sun shade is radially positioned. However, due to sun shading umbrella popularity, crowded areas, including but not limited to beaches and the like, are often overrun by mass mundane collections of umbrella canopies. And often, it is difficult, or inconvenient, to differentiate specific umbrellas and/or personalize beachgoer setups.

Thus, Applicant desires cost-effective and user-friendly umbrella assemblies and systems that are useful and maintain the integrity of the umbrella and flag in a variety of set-ups and environments.

SUMMARY

In accordance with the present disclosure, umbrella assemblies and systems are provided for achieving and maintaining proper canopy and flag orientation, so that the umbrella and corresponding flag(s) will perform as intended.

In one embodiment, an umbrella assembly comprises an umbrella having a central pole with a head portion, wherein the head portion includes a channel with an upper region and a lower region, and wherein a finial plug is adapted to align along the upper region; a flagstaff having a diameter sized to mate within the finial plug, and wherein the finial plug adapted to removably mount a lower length of the flagstaff.

In certain examples, the lower length of the flagstaff is aligned below a mounting surface in an assembled position. The flagstaff may extend from the finial plug independent of an opened extended canopy position and a closed retracted position. The channel may include at least one alignment member. The finial plug may include an outer diameter sidewall extending from a retaining base and an aperture. The finial plug may include an outer diameter sidewall extending from a retaining base, an inner diameter sidewall extending from the outer diameter sidewall, and an aperture recessed within the inner diameter sidewall. The outer diameter sidewall may be sized to complement a channel for receiving and retaining the finial plug. The umbrella may include a rib assembly with an end cap attached to a distal end of each rib, wherein the end cap including a channel with an adjustable depth for receiving at least one of the ribs. The end cap may modify the tension of the canopy to prevent excessive or insufficient tension when the canopy is mounted by adjusting a depth of one or more channels before the distal end of the rib is inserted.

The assembly may include a base tarp having a reinforcement disposed centrally within the tarp, an opening disposed within the reinforcement, a plurality of spaced apart grommets disposed outwardly within the tarp, whereby each grommet is adapted to be attached to the pole. The assembly may include a hub for the rib assembly to attach to the pole. The assembly may include a vent aligned below the flagstaff and adapted to vent air through the canopy. The assembly may include at least one insert aligned within the channel and adapted modify a tension of the canopy by extending an effective length of the rib of the umbrella frame.

In another embodiment, an umbrella system comprises a central pole having a head portion; a plurality of radially depending ribs pivotally mounted adjacent the head portion supporting a canopy; and an aperture on a distal end of the central pole above the head portion.

In certain examples, the aperture includes a finial plug aligned within a channel above an alignment member. The finial plug may removably mount a lower length of a flagstaff. The finial plug may include an outer diameter sidewall extending from a retaining base and an aperture. The finial plug may include outer diameter sidewall extending from a retaining base, an inner diameter sidewall extending from the outer diameter sidewall, and an aperture recessed within the inner diameter sidewall. In particular examples, the system includes a flagstaff.

In yet another embodiment, an umbrella assembly comprises an umbrella having a central pole with a channel having at least one alignment member and a finial plug extending from a retaining base; and a flagstaff extending from the finial plug independent of an opened extended canopy position and a closed retracted position, and wherein a lower length of the flagstaff aligned below a mounting surface in an assembled position.

In a further embodiment, an umbrella assembly includes a pole having a rib assembly at one end comprising a plurality of ribs aligning a canopy; and a distal finial plug; and a base.

In certain examples, the assembly incudes a flagstaff. The finial plug may removably mount a lower length of the flagstaff. The flagstaff may include a proximate flag connection. The proximate flag connection may include at least one proximate connector. The flagstaff may include a distal flag connection. The distal flag connection may include at least one distal connector. The finial plug may have an outer diameter sidewall extending from a retaining base and an aperture. The finial plug may include an outer diameter sidewall extending from a retaining base, an inner diameter sidewall extending from the outer diameter sidewall, and an aperture recessed within the inner diameter sidewall.

In particular examples, the canopy includes a channel having an upper region and a lower region; wherein the finial plug adapted to align along the upper region. The channel may include at least one alignment member. The channel may include a pair of opposing alignment members. The finial plug may align within the channel above the alignment member. The lower length of the flagstaff may align below a mounting surface in an assembled position. The flagstaff may extend from the finial plug independent of an opened extended canopy position and a closed retracted position.

In certain examples, the assembly includes rib assembly comprising a plurality of ribs. The rib assembly may include an end cap assembly attached to a distal end of each rib, wherein the end cap assembly including a channel with an adjustable depth for receiving the rib. The end cap assemblies may modify the tension of the canopy to prevent excessive or insufficient tension when the canopy is mounted by adjusting a depth of one or more channels before the distal end of the rib is inserted.

In some examples, the base may be installed on the bottom of the pole for retaining the umbrella in an upright position. The base may include a tarp including a reinforcement disposed centrally within the tarp, an opening disposed within the reinforcement, a plurality of spaced apart grommets disposed outwardly within the tarp, whereby each grommet is adapted to be attached to the pole.

In particular examples, the assembly includes a hub for the rib assembly to attach to the pole. The assembly may include pulley assembly to open and close the canopy and a pin adapted to be inserted into a hole in the pole to retain the canopy in an open configuration. The assembly may include a crank assembly adapted to open and close the canopy. The assembly may include a tilt mechanism attached onto the pole to tilt the rib assembly and canopy at an angle with respect to the pole. The assembly may include a vent on the canopy for air to pass through the canopy. The assembly may include one or more inserts adapted to fit within the channel of the tube to modify the tension of the canopy by extending an effective length of the rib of the umbrella frame. For instance, the tension of the canopy can be increased by adding inserts into the tube to increase the effective length of the rib that the end cap assembly is attached to and the tension of the canopy can be decreased by removing inserts from the tube to decrease the effective length of the rib that the end cap assembly is attached thereto.

In another embodiment, an umbrella assembly includes an umbrella with a radially extending canopy and a finial plug; and a flagstaff with multi flag alignment connector fasteners.

In yet another embodiment, an umbrella assembly includes an umbrella having a finial plug secured along a distal portion of a canopy; a flagstaff having a diameter sized to mate within the finial plug, and wherein the flagstaff being removably mounted in a substantially vertical position within the finial plug.

In some examples, the umbrella comprising a central pole having a head portion. The head portion may include a channel having an upper region and a lower region, wherein the finial plug adapted to align along the upper region. The channel may include at least one alignment member. The channel may include a pair of opposing alignment members. The finial plug may align within the channel above the alignment member. The finial plug may removably mount a lower length of the flagstaff. The finial plug may have an outer diameter sidewall extending from a retaining base and an aperture. The finial plug may include an outer diameter sidewall extending from a retaining base, an inner diameter sidewall extending from the outer diameter sidewall, and an aperture recessed within the inner diameter sidewall. The outer diameter sidewall may be sized to complement a channel for receiving and retaining the finial plug.

In certain examples, the lower length of the flagstaff is aligned below a mounting surface in an assembled position. The flagstaff may extend from the finial plug independent of an opened extended canopy position and a closed retracted position. The umbrella may include a rib assembly comprising a plurality of ribs. The umbrella may include a rib assembly comprising an end cap assembly attached to a distal end of each rib, wherein the end cap assembly including a channel with an adjustable depth for receiving the rib. The end cap assemblies may modify the tension of the canopy to prevent excessive or insufficient tension when the canopy is mounted by adjusting a depth of one or more channels before the distal end of the rib is inserted.

In particular examples, the assembly includes a base installed on the bottom of the pole adapted for retaining the umbrella in an upright position. The base may include a tarp including a reinforcement disposed centrally within the tarp, an opening disposed within the reinforcement, a plurality of spaced apart grommets disposed outwardly within the tarp, whereby each grommet is adapted to be attached to the pole.

In some examples, the assembly may include a hub for the rib assembly to attach to the pole. The assembly may include a pulley assembly to open and close the canopy and a pin adapted to be inserted into a hole in the pole to retain the canopy in an open configuration. The assembly may include a crank assembly adapted to open and close the canopy. The assembly may include a tilt mechanism attached onto the pole to tilt the rib assembly and canopy at an angle with respect to the pole. The assembly may include a vent on the canopy for air to pass through the canopy. The assembly may include one or more inserts adapted to fit within the channel of the tube to modify the tension of the canopy by extending an effective length of the rib of the umbrella frame. For instance, the tension of the canopy can be increased by adding inserts into the tube to increase the effective length of the rib that the end cap assembly is attached to and the tension of the canopy can be decreased by removing inserts from the tube to decrease the effective length of the rib that the end cap assembly is attached thereto.

In another embodiment, an umbrella system includes a central pole having a head portion; a plurality of radially depending ribs pivotally mounted adjacent the head portion supporting a canopy; and an aperture on a distal end of the central pole above the head portion.

In some examples, the aperture comprises a finial plug. The finial plug may align within a channel above an alignment member. The finial plug may removably mount a lower length of a flagstaff. The finial plug may include an outer diameter sidewall extending from a retaining base and an aperture. The finial plug may include an outer diameter sidewall extending from a retaining base, an inner diameter sidewall extending from the outer diameter sidewall, and an aperture recessed within the inner diameter sidewall.

The system may include a flagstaff. The flagstaff may include a proximate flag connection. The proximate flag connection may include at least one proximate fastener. The flagstaff may include a distal flag connection. The distal flag connection may include at least one distal fastener.

In one embodiment, an umbrella comprises a frame having a pole with a rib assembly at one end, the rib assembly comprising a plurality of ribs; an end cap assembly attached to a distal end of each rib, the end cap assembly including a channel with an adjustable depth for receiving the rib; and a canopy attached to the end cap assembly of each rib of the frame. The end cap assemblies are adapted to modify the tension of the canopy to prevent excessive or insufficient tension when the canopy is mounted by adjusting the depth of one or more channels before the distal end of the rib is inserted. The end cap assembly may be tubular.

The umbrella may further include a base installed on the bottom of the pole adapted for retaining the umbrella in an upright position. For example, the base may be comprised of a rigid container adapted for receiving a fluid. In another example, the base may be a tarp including a reinforcement disposed centrally within the tarp, an opening disposed within the reinforcement, a plurality of spaced apart grommets disposed outwardly within the tarp, whereby each grommet is adapted to be attached to the pole.

One embodiment of the umbrella includes a hub for the rib assembly to attach to the pole. A pulley assembly may be included to open and close the canopy and further include a pin to be inserted into a hole in the pole to retain the canopy in an open configuration. In another example, a crank assembly may be included to open and close the canopy. The umbrella may also include a tilt mechanism attached onto the pole to tilt the rib assembly and canopy at an angle with respect to the pole.

A finial may be added to the top of the canopy. The canopy may further include a vent for air to pass through the canopy.

Another aspect of the present invention is directed to an end cap assembly adapted to be installed onto a distal end of a rib for an umbrella frame to modify the tension of a canopy attached to the umbrella frame. The end cap assembly comprises a tube having an open end with a channel adapted to receive a rib of an umbrella frame and a closed end adapted to be received by a canopy; and one or more inserts adapted to fit within the channel of the tube to modify the tension of the canopy by extending an effective length of the rib of the umbrella frame. The tension of the canopy can be increased by adding inserts into the tube to increase the effective length of the rib that the end cap assembly is attached to and the tension of the canopy can be decreased by removing inserts from the tube to decrease the effective length of the rib that the end cap assembly is attached to.

In one embodiment, the closed end of the tube is substantially T-shaped.

The insert may be comprised of rubber. Between about one and about four inserts may be inserted into the tube.

In some examples, the length of the tube may range between about 1 inch to about 5 inches. For instance, the length of the tube may be about 2.5 inches. In some examples, the depth of the insert is between about 5 millimeters and about 20 millimeters. For instance, the depth of the insert may be about 10 millimeters.

Still another aspect of the present invention is directed to an umbrella comprising a frame having a pole with a rib assembly at one end, the rib assembly comprising a plurality of ribs; an end cap assembly attached to a distal end of each rib to modify the tension of a canopy attached to the umbrella frame; and a canopy attached to the end cap assembly of each rib of the frame. The end cap assembly comprises a tube having an open end with a channel adapted to receive a rib of an umbrella frame and a closed end adapted to be received by a canopy; and one or more inserts adapted to fit within the channel of the tube to modify the tension of the canopy by extending an effective length of the rib of the umbrella frame. The tension of the canopy can be increased by adding inserts into the tube to increase the effective length of the rib that the end cap assembly is attached to and the tension of the canopy can be decreased by removing inserts from the tube to decrease the effective length of the rib that the end cap assembly is attached to.

The present invention may also be considered a method for adjusting the canopy tension of an umbrella. In one example, each rib is fitted with a "T" shape tubular end cap. The cap may be loosely fitted so that it can be easily removed without the use of any tools. A small insert may then be added to each cap before it is attached to the rib. By doing so, the rib has been effectively lengthened by the size of the insert. After all end caps have been attached to the ribs, the canopy is attached and the umbrella opened and checked for tension. If the tension is too loose, then additional inserts may be added effectively lengthening each rib. Conversely, if the canopy is too tight then inserts can be removed effectively reducing the length of the rib.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF THE PREFERRED EMBODIMENTS

Figure 1:
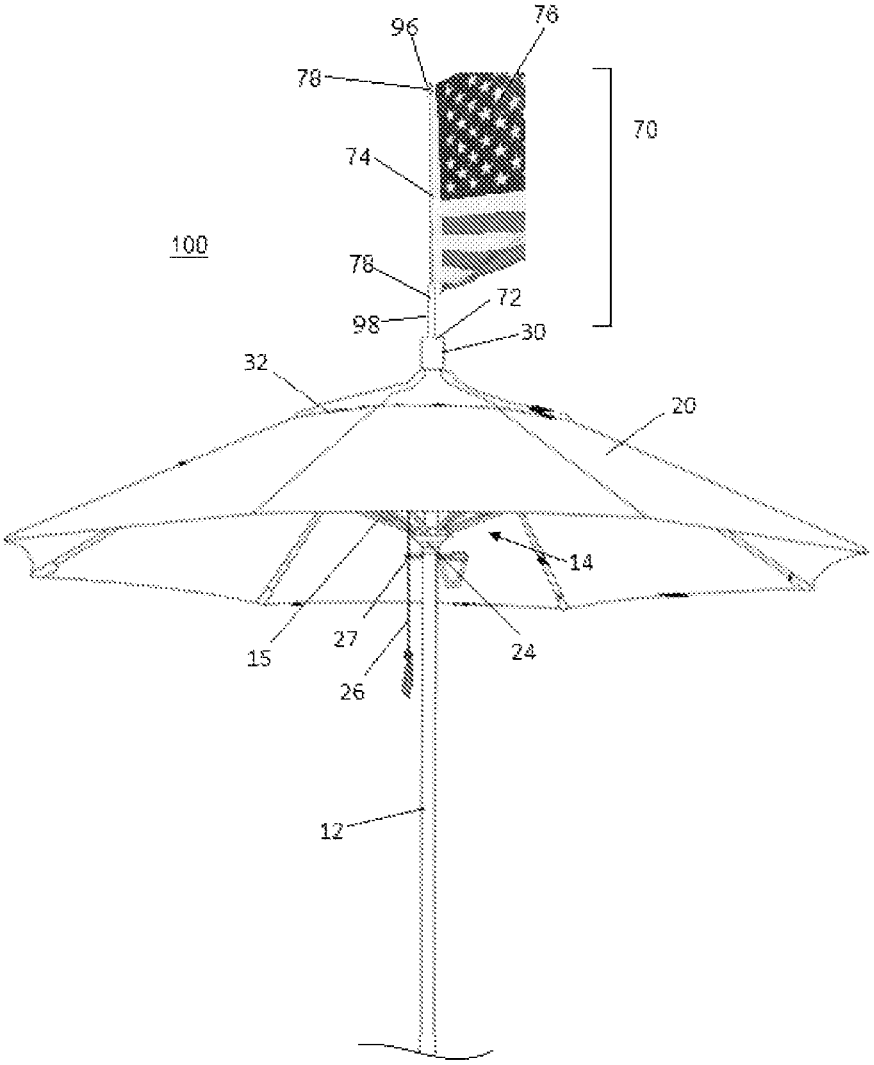
FIG. 1 is a front perspective view of an umbrella assembly according to one embodiment of the present invention.
Figure 1A:
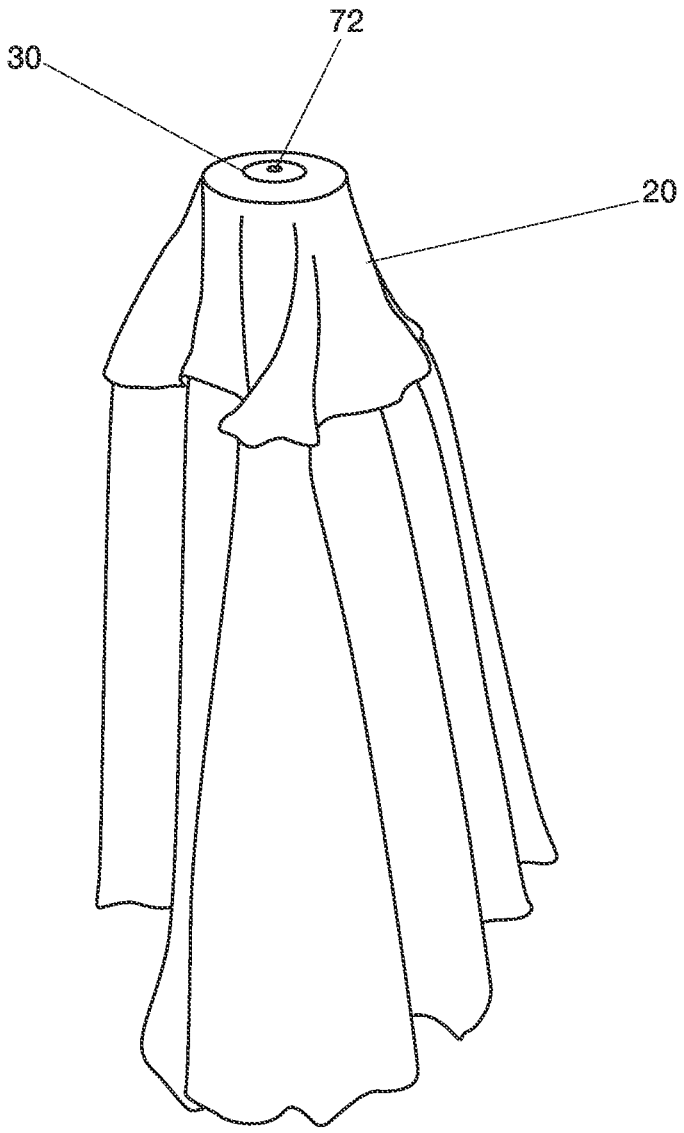
FIG. 1*a* is a front perspective view of a folded arrangement of elements shown in FIG. 1.
Figure 1B:
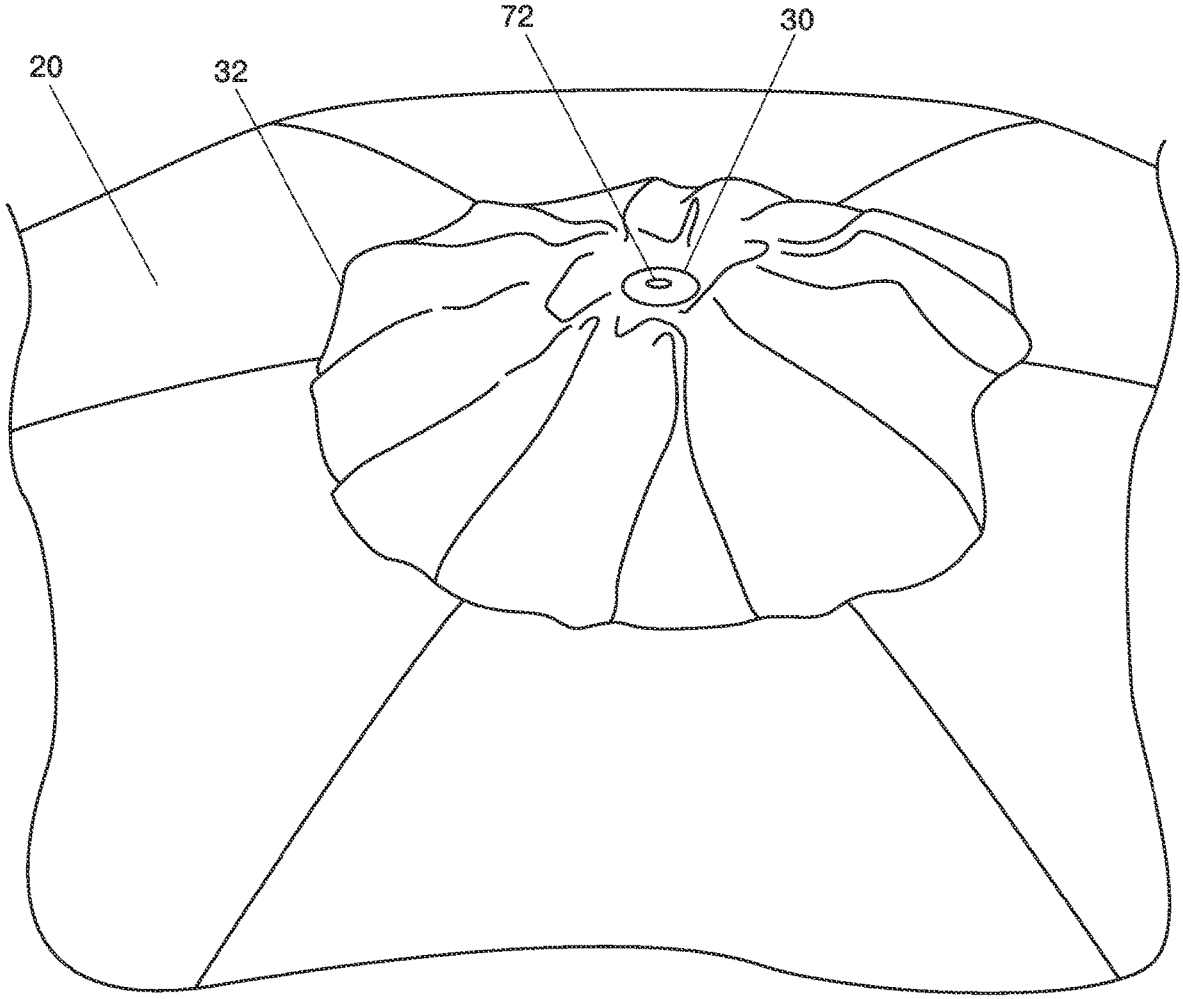
FIG. 1*b* is a top perspective view of isolated elements shown in FIG. 1, with elements removed for clarity.
Figure 1C:
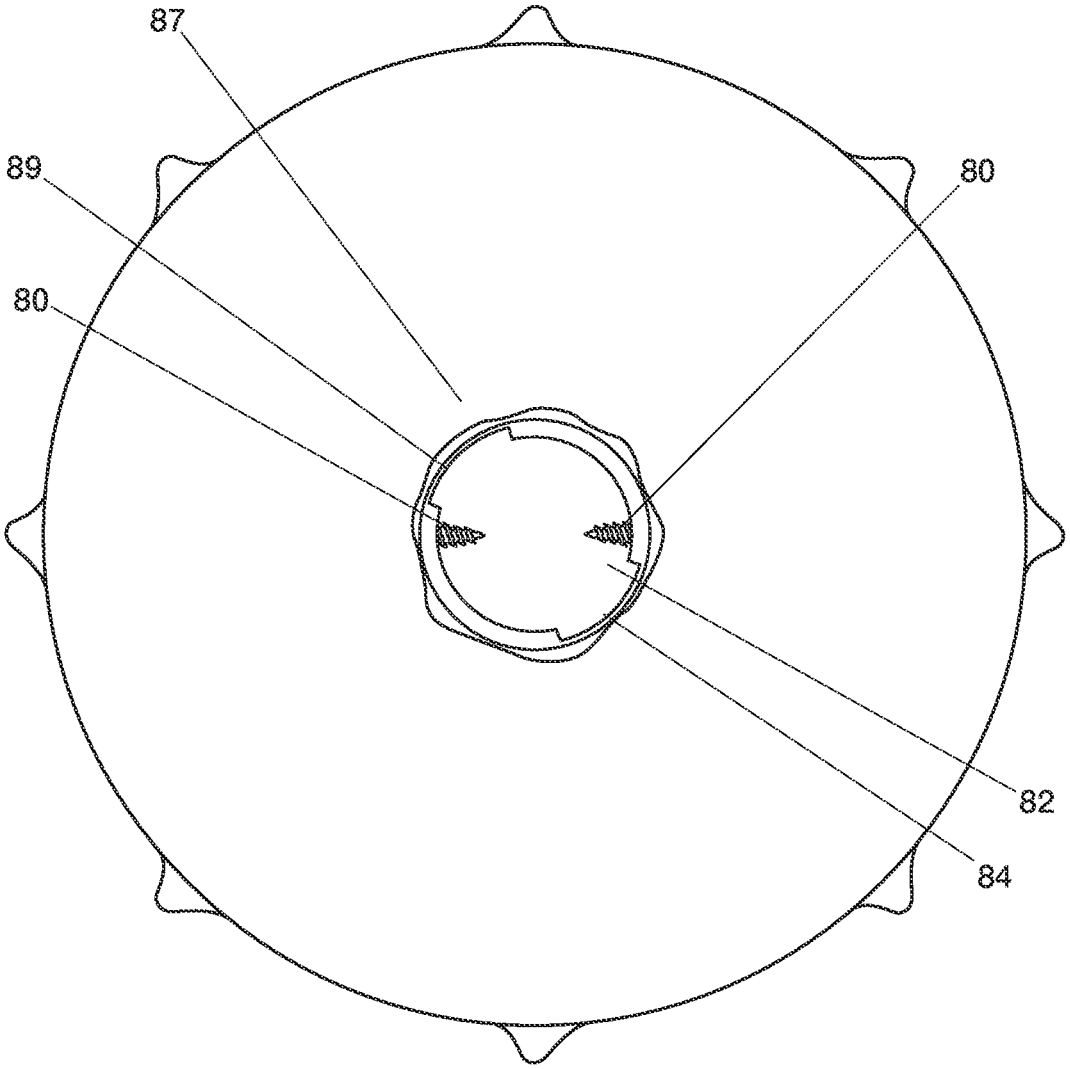
FIG. 1*c* is a top perspective view of isolated elements shown in FIG. 1, with elements removed for clarity.
Figure 1D:
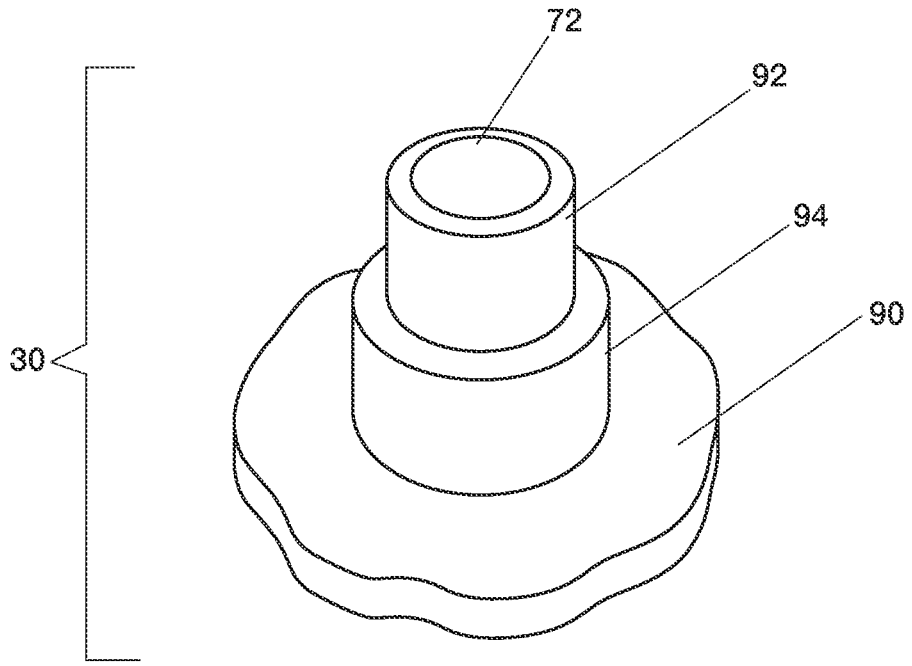
FIG. 1*d* is a side perspective view of an isolated plug introduced in FIG. 1.
Figure 1E:
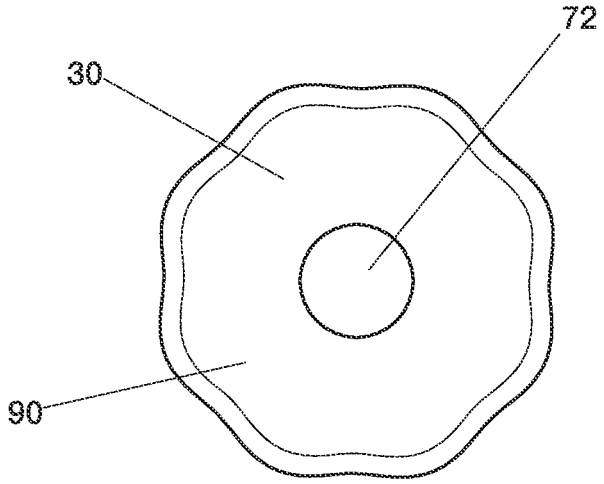
FIG. 1*e* is a bottom perspective view of an isolated plug introduced in FIG. 1.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing an embodiment of the invention and are not intended to limit the inventions thereto.

FIG. 1 introduces flagstaff assembly 70 removably mounted about umbrella assembly 100 is comprised of a pole 12 having a rib assembly 14 to support a canopy 20. One or more ribs 15 includes an end cap assembly at its distal end, wherein each end cap assembly is inserted into the canopy 20 to mount it onto the rib assembly 14. As shown, the flagstaff assembly 70 generally incudes at least one flag 76, but including two or more as shown and described herein, secured to flagstaff 74 at connector fasteners 78. Flagstaff 74 is generally removably mounted in a substantially vertical position within an aperture, finial plug 30, or the like in the upper portion of the pole 12 or canopy 20.

In one embodiment of canopy 20 in a closed retracted position, the finial plug 30 is secured along a distal portion of canopy 20, and includes aperture 72 to receive and retain any of the flagstaffs shown and described herein.

In one embodiment of upper canopy 20 a channel 82 in opening 89 generally receives and retains a corresponding finial plug or the like. The opening 89 may be aligned along a substantially flat mating surface 87. The channel 82 may have an upper region and a lower region, thus the finial plug may align along the upper region. As shown, channel 82 may have one, including at least a pair of opposing, alignment members 80.

In certain examples, finial plug 30 may be sized for snug slide mounting downwardly into channel 82, for instance to telescopically slide into channel 82. In particular examples, the outer diameter sidewall 94 is sized to snugly telescopically slide into channel 82 about alignment members 80 to ease movement of the pole within the distal portion of the canopy as shown and described herein.

Those of ordinary skill in the art having the benefit of this disclosure will recognize numerous connection and arrangement configurations between the umbrella canopy/top end and the corresponding flagstaff. In certain embodiments, finial plug 30 has an outer diameter sidewall 94 extending from a retaining base 90 to support aperture 72. In certain examples, finial plug 30 has an outer diameter sidewall 94 extending from retaining base 90, an inner diameter sidewall 92 extending from outer diameter sidewall 94 (or the like), with aperture 72 recessed within inner diameter sidewall 92.

The embodiments and examples herein support one, two, and a plurality of flags, and the like, above the umbrella in a variety of configurations. The flagstaff 74 includes connectors to mount flag 76 in a semi-fixed position to flagstaff pole 74. In certain embodiments, flagstaff 74 includes a distal flag connection 96 to secure a first flag (or the like) and a proximate flag connection 98 to secure at least a second flag (or the like). The distal flag connection 96 includes at least one distal connection fastener 78 to secure flag 76, or the like. Further, in certain examples, the proximate flag connection 98 includes at least one proximate connection fastener 78' to secure a second or additional flag, or the like. In certain examples, flagstaff 74 may be generally cylindrical and elongated along an axis. Flag 76 may be repositionable about pole 74 as shown and described herein.

As shown in the various figures, pole 12 may be supported by a base 22. For instance, the base 22 may comprise a rigid container with sand, water or another fluid inside. The rib assembly 14 may be attached to the pole 12 via a hub 24. When the hub 24 is raised along the pole 12, the canopy 20 is opened. As the hub 24 is lowered along the pole 12, the canopy 20 is closed. A pulley assembly 26 may be included to raise and lower the hub 24. The hub 24 may be held in its position using a pin 27.

The canopy 20 may also include a vent 32 for air to pass through the canopy in order to enable heat to escape from underneath the umbrella and allow cool air to enter under the umbrella.

Figure 2:
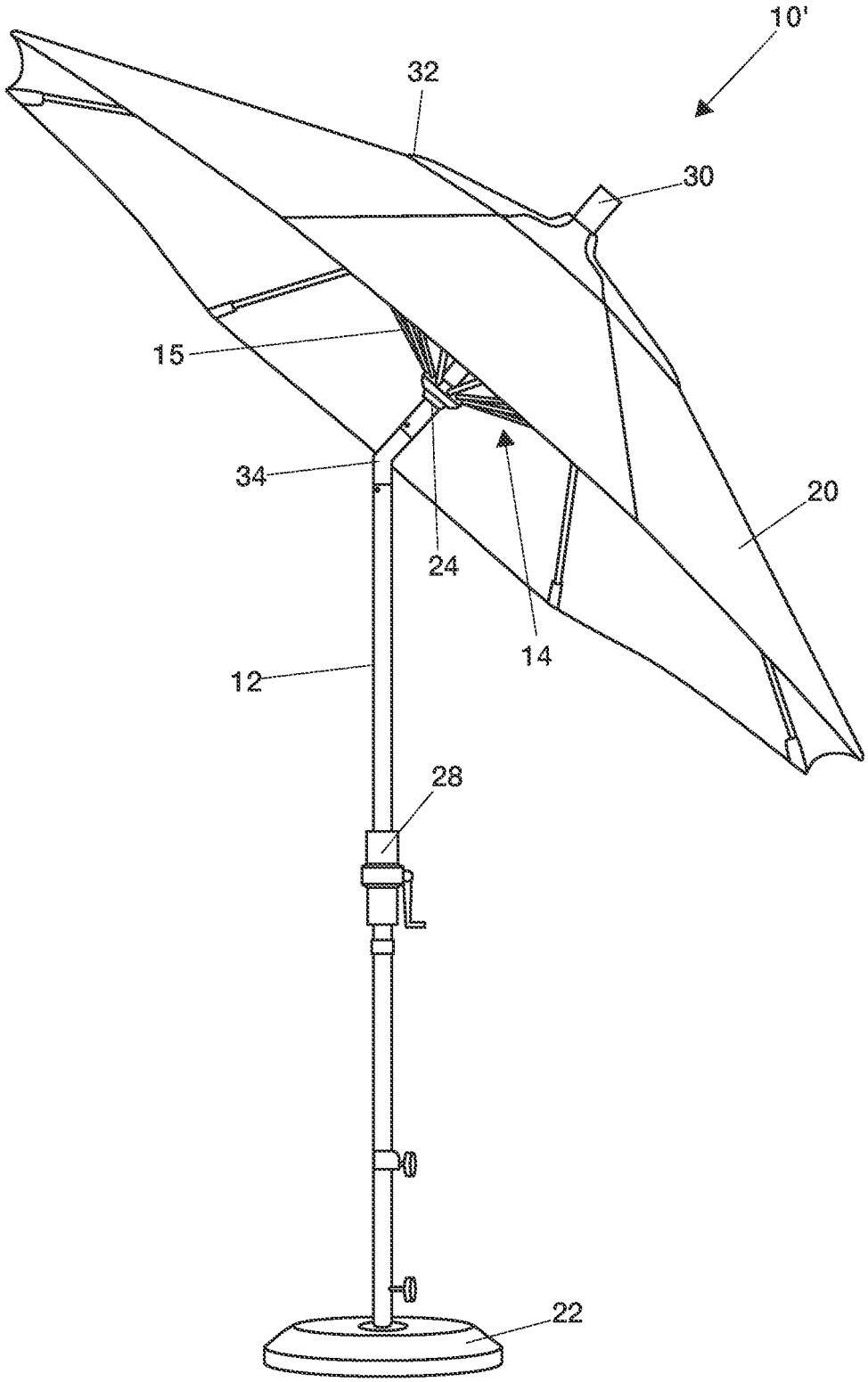
FIG. 2 is a front perspective view of an umbrella according to another embodiment.

Another example of an umbrella 10' having a canopy tension system is shown in FIG. 2. The umbrella includes a crank assembly 28 adapted to open and close the canopy, and further includes a tilt mechanism 34 for angling the canopy in a desired direction.

Figure 3:
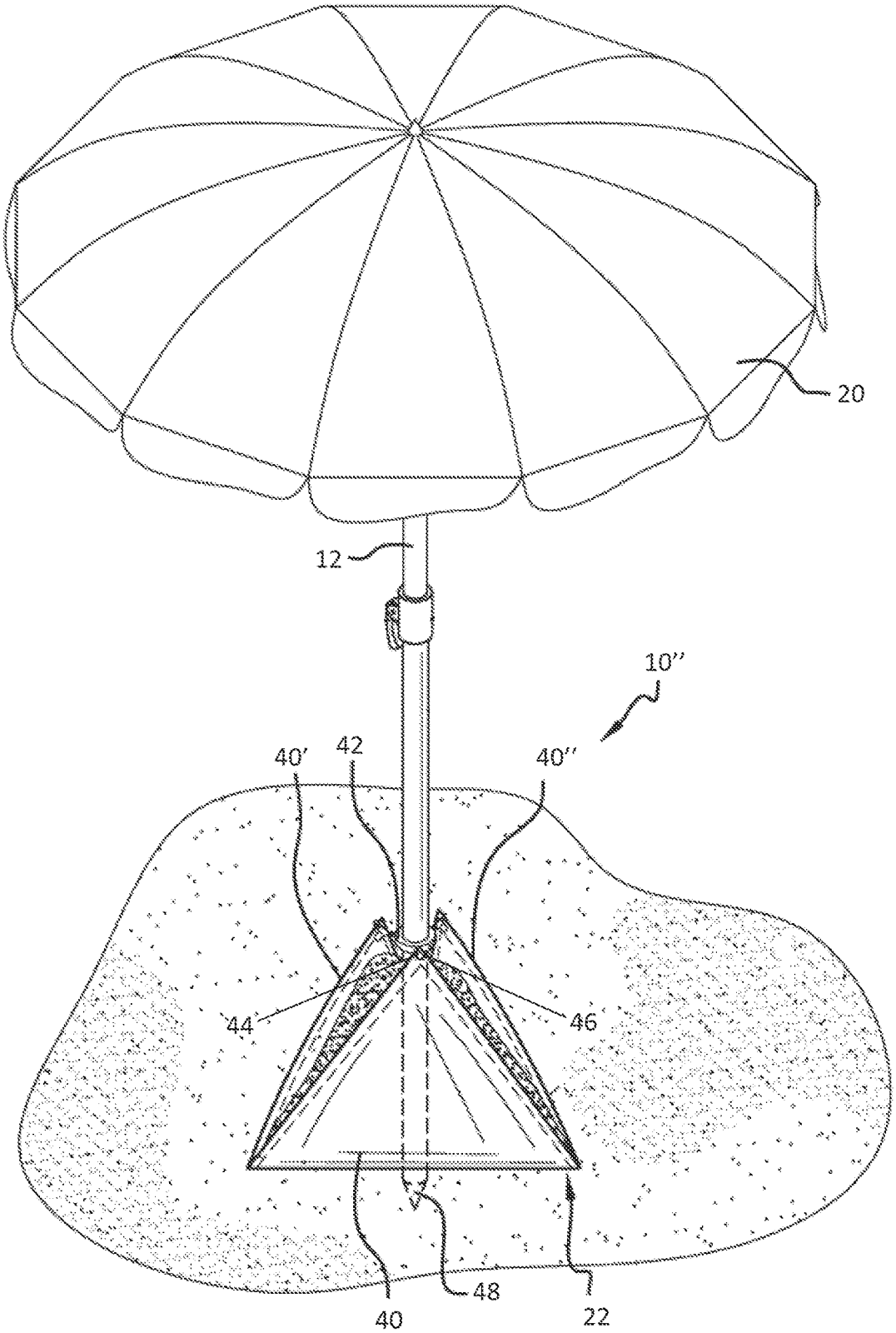
FIG. 3 is a top perspective view of an umbrella according to another embodiment.

FIG. 3 illustrates another example of an umbrella 10" with a canopy tension system. The umbrella 10" is supported by a base 22. In this example, the base 22 is comprised of a tarp 40 adapted to attach to a collar 42 installed onto the pole 12. In one embodiment, the tarp 40 is comprised of three outer triangles 40, 40', 40" that attach to the collar 42. Each outer triangle 40 may be attached to the collar 42 via a grommet 44 that engages with a fastener 46 on the collar 42. Other similar mechanisms may also be used to attach the tarp 40 to the pole 12, including fasteners installed directly onto each outer triangle 40 that are inserted into holes on the pole 12 or collar 42. The tarp 40 also includes a reinforcement with an opening for the end 48 of pole 12 to insert through and into the ground. Sand may be used to fill the base 12.

Figure 4:
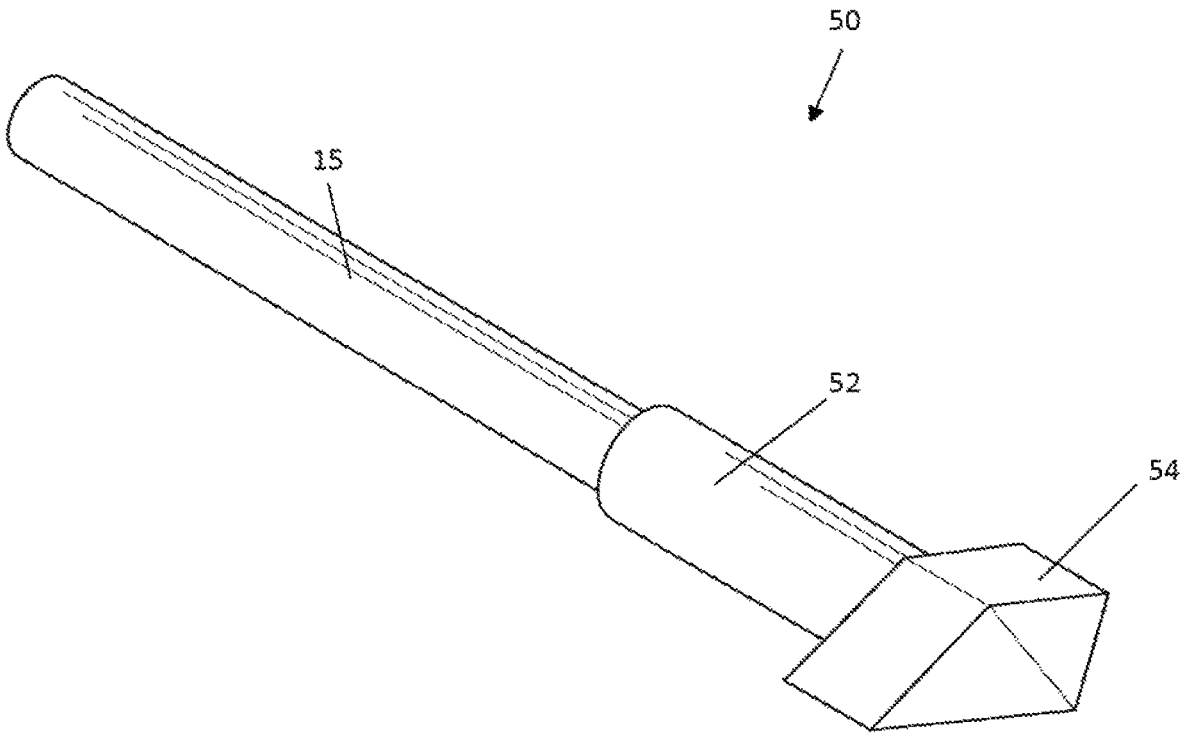
FIG. 4 is a top perspective view of an end cap assembly according to one embodiment.
Figure 5:
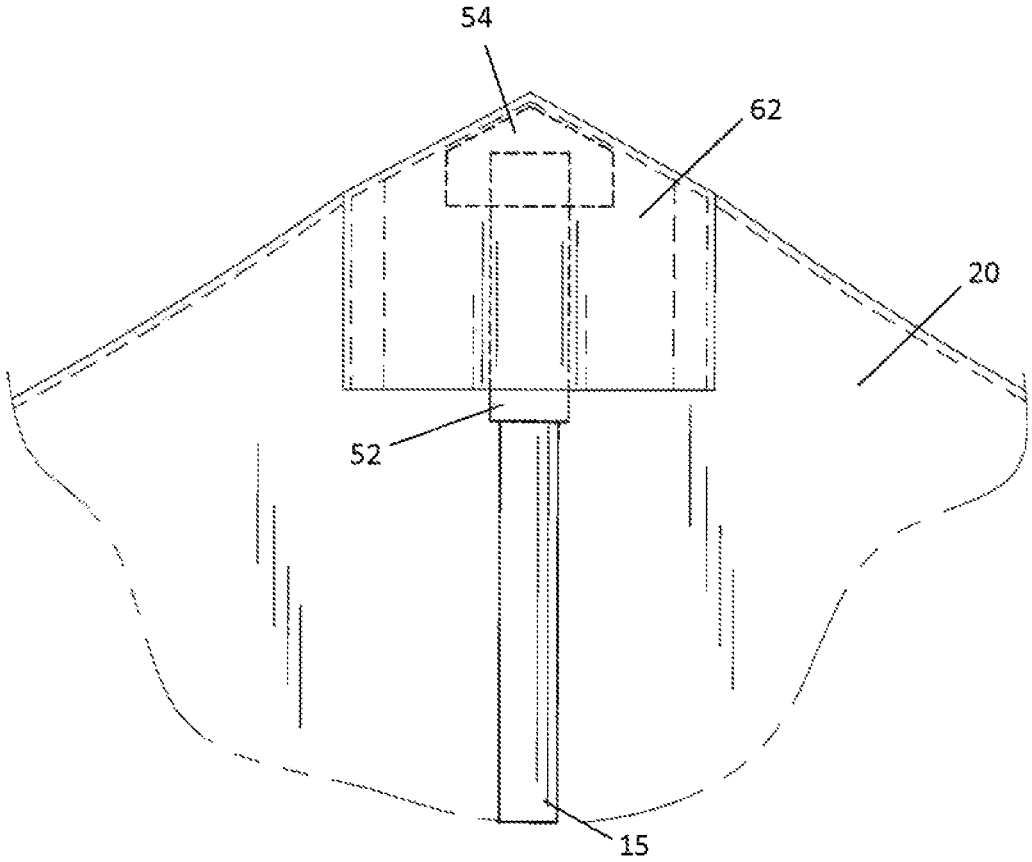
FIG. 5 is an enlarged cross-sectional view of an end cap assembly installed over a rib inserted into a canopy.
Figure 6:
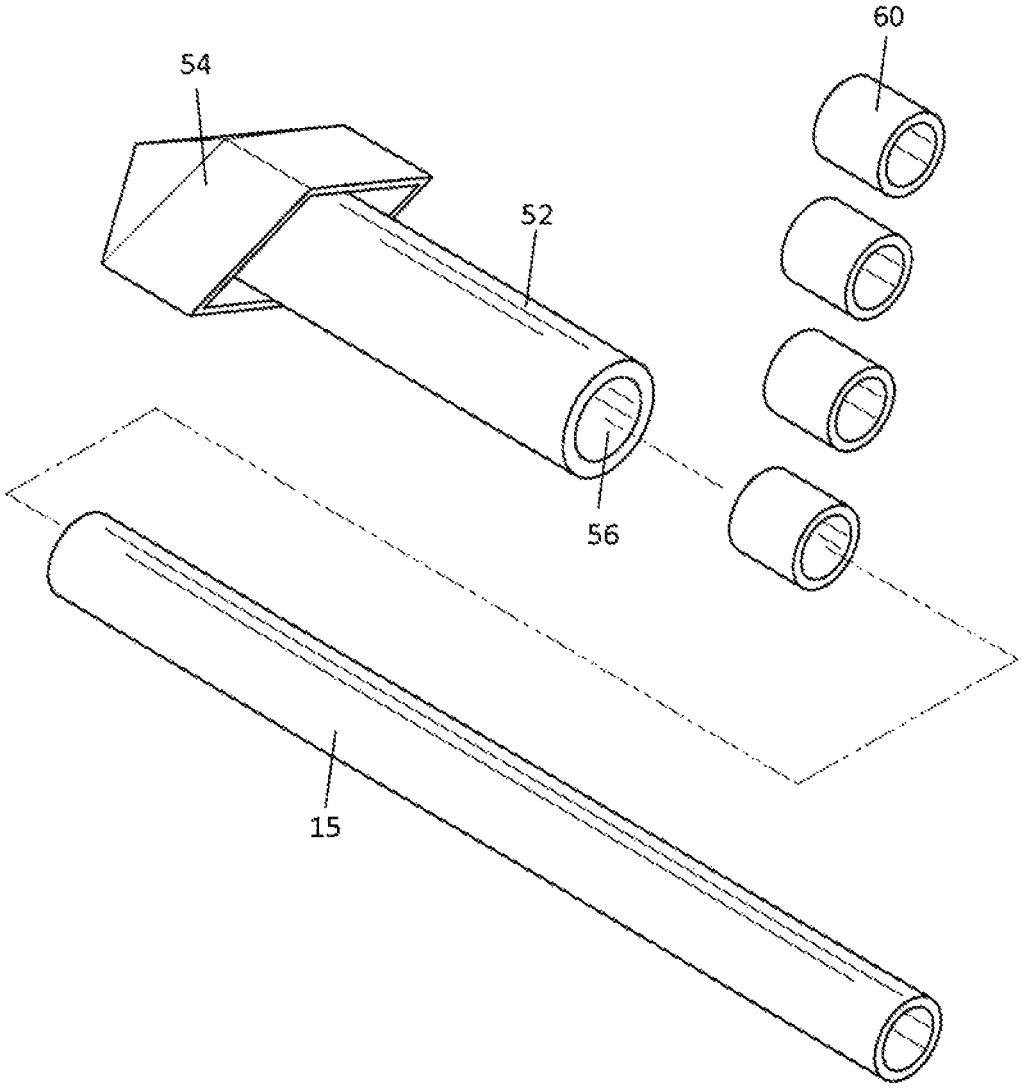
FIG. 6 is a disassembled view of the end cap assembly shown in FIG. 4.

One example of an end cap assembly 50 to be used as a canopy tension system is shown in FIGS. 4-6. The end cap assembly 50 is comprised of a tube 52 adapted to receive a distal end of rib 15 (wherein the proximal end of rib 15 is attached to the hub 24). The tube 52 may further include a T-shaped end 54 adapted to disperse pressure on the canopy when inserted into pocket 62 of the canopy 20 to prevent the tube 52 from slipping out.

Figure 7:
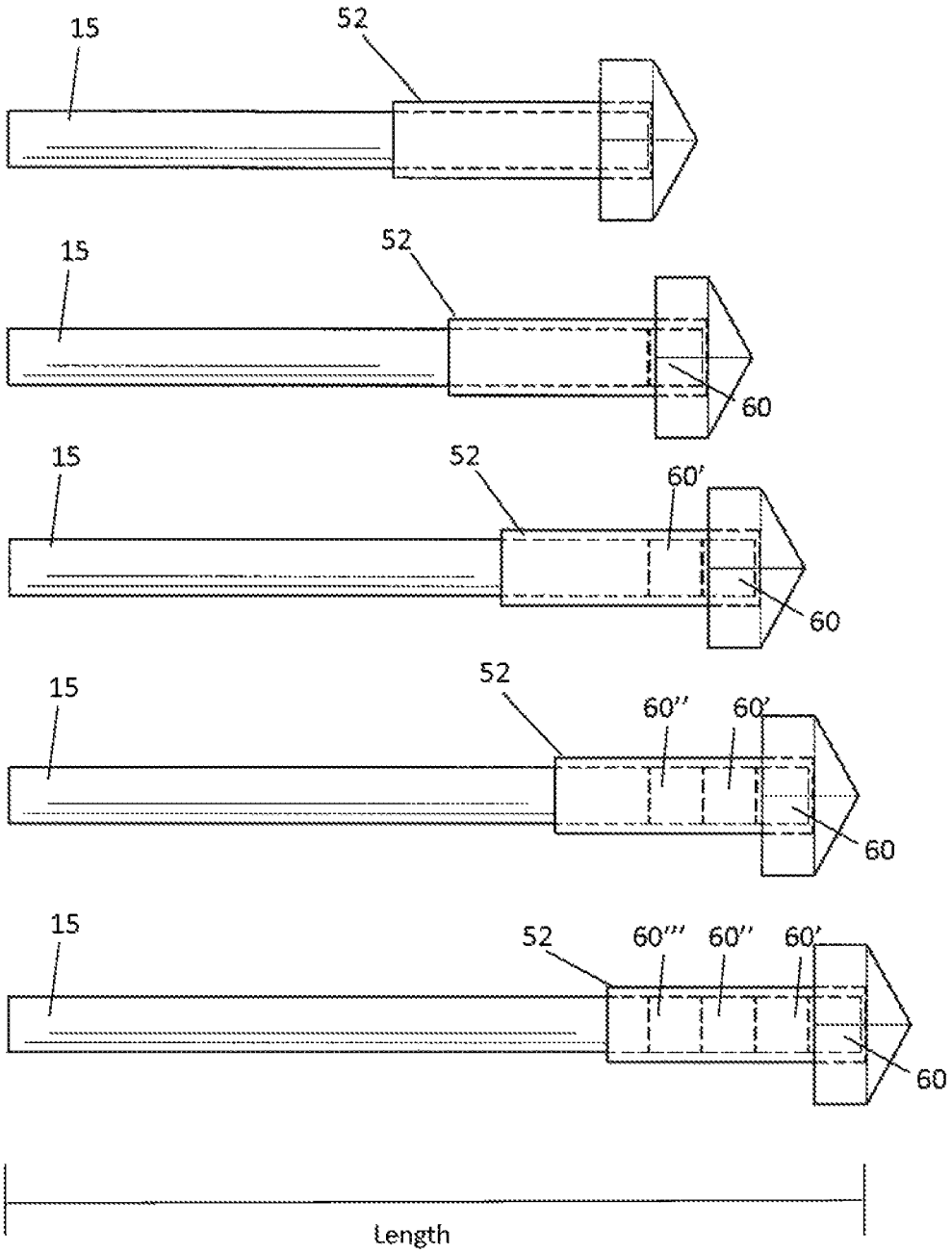
FIG. 7 is a partially cross-sectional view of the end cap assembly shown in FIG. 4.

FIG. 6 provides a partially disassembled view of the end cap assembly 50 wherein a plurality of inserts 60 may be inserted into a channel 56 prior to insertion of the rib 15 into the channel 56. FIG. 7 illustrates the effect of adding one or more inserts 60 into the tube 52. As each insert 60 is added to the tube 52, the depth of the channel 56 decreases for the rib 15 to enter into. By decreasing the depth for the rib 15 to enter, the effective length of the rib 15 increases when inserted into the pocket 62 of the canopy 20.

Preferably, the length of the tube 52 is within a range wherein inserting the rib 15 into the end cap assembly 50 still results in an overall length wherein the canopy 20 can be mounted onto the rib assembly 14. For example, the tube may have a length within a range of about 1 inch to about 5 inches. In one embodiment, the tube 52 may have a length of about 2.5 inches.

Figure 8:
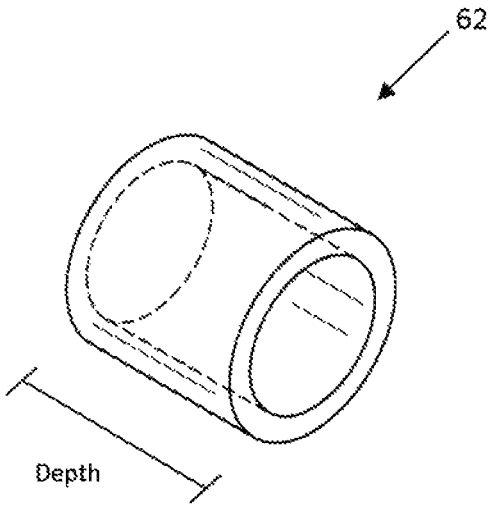
FIG. 8 is a side perspective view of an insert according to one embodiment of the present invention.

One example of an insert 60 adapted to be inserted into the tube 52 is shown in FIG. 8. The depth of each insert 60 is preferably within a range that is large enough to provide a discernible effect on the tension of a canopy 20 with each insert added/removed, while at the same time, is small enough so that the tension of the canopy 20 can be adequately fine-tuned (i.e., adding or removing an insert 60 does not cause such an increase/decrease in canopy tension that the tension cannot be properly calibrated). For example, the depth of the insert may range between about 5 millimeters and about 20 millimeters. In one embodiment, the depth of the insert is about 10 millimeters, wherein each insert 60 provides about an additional 0.25 lb of tension to the canopy.

In operation, the end cap assembly may be used to adjust the tension of a canopy by modifying the effective length of the ribs to be inserted into the canopy. The initial tension may be determined by the size of the frame and the size of the canopy. During manufacturing of the umbrella itself, there are 9 possible outcomes that determine the tension of the canopy. The frame and canopy can be too small, just right or too large. When the canopy is attached to the frame, the statistical probability that the tension will be within an acceptable range is as follows:

1) Loose Canopy: F1+C2 or F2+C3
2) Tight Canopy: F2+C1 or F3+C2
3) Extremely Loose: F1+C3
4) Extremely Tight: F3+C1
5) Within acceptable range: F1+C1 or F2+C2 or F3+C3 wherein F1=Frame too small; F2=Frame acceptable; F3=Frame too large; C1=Canopy too small; C2=Canopy acceptable; C3=Canopy too large.

The end cap assembly provides a solution for examples 1-4, wherein the frame and canopy have dimensions that are not within an initially acceptable range. For umbrellas that have a frame and canopy combination resulting in a loose canopy, the end cap assembly can be added to one or more ribs along with one or more inserts to increase the size of the frame to increase the tension within an acceptable range. For umbrellas that have a frame and canopy combination resulting in a tight canopy, the ribs may be initially shortened to reduce canopy tension, and an end cap assembly may be added to fine-tune the effective length of the rib to create the desired canopy tension. Moreover, as the canopy loosens over time, additional inserts may be added to the end cap assembly to maintain proper canopy tension. If the canopy tension becomes too tight, one or more inserts may be removed from the tube.

Certain modifications and improvements will occur to those skilled in the art upon a reading of the foregoing description. The end cap assembly may be used in a variety of umbrellas to adjust the tension of a canopy, and is not limited by the embodiments disclosed herein. Moreover, the depth of the channel may be adjusted by other means. For example, the end cap assembly may comprise a series of tubes with different lengths and/or channel depths wherein the tension of the canopy may be adjusted by inserting a tube having the desired length and/or channel depth. It should be understood that all such modifications and improvements have been deleted herein for the sake of conciseness and readability but are properly within the scope of the following claims.

I claim:

1. An umbrella assembly consisting of:

a. an umbrella having a central pole consisting of a channel with an upper portion and an elongated alignment member, and wherein a finial plug having an outer diameter sidewall extending from a substantially perpendicular retaining base and having an opposing aperture within an inner sidewall telescopically aligns snuggly along said upper region;

b. a first flag having at least one connection point, and a second flag having at least one connection point; and c. a flagstaff having a diameter sized to repositionably mate within said finial plug, and wherein said flagstaff having a distal flag connection securing said first flag, and a proximate flag connection spatially separated from said distal flag connection and securing said second flag independent of said first flag, and wherein said finial plug removably mounts a lower length of said flagstaff opposing said mounted flags, and wherein said flagstaff aligned below a mounting surface in an assembled position and extends longitudinally away from said finial plug away from said umbrella independently of an opened extended canopy position and a closed retracted position, and wherein said closed retracted position said flagstaff extends longitudinally away from said finial plug away from said umbrella.

2. The assembly of claim 1, wherein said finial plug having an outer diameter sidewall extending from a retaining base, an inner diameter sidewall extending from said outer diameter sidewall, and an aperture recessed within said inner diameter sidewall.

3. The assembly of claim 2, wherein said outer diameter sidewall sized to complement said channel for receiving and retaining said finial plug.

4. The assembly of claim 1, wherein said umbrella having a rib assembly with an end cap attached to a distal end of each rib, wherein said end cap including a tensioning channel with an adjustable depth for receiving at least one of said ribs.

5. The assembly of claim 4, wherein said end cap is adapted to modify a fine-tuning of said tension of said canopy to prevent excessive or insufficient tension when said canopy is mounted by adjusting a depth of one or more channels before said distal end of the rib is inserted.

6. The assembly of claim 4, including a hub for the rib assembly to attach to said pole.

7. The assembly of claim 4, including at least one insert aligned within a tensioning channel and adapted modify said fine-tuning tension of the canopy by extending an effective length of the rib of the umbrella frame.

8. The assembly of claim 1, including a tarp having a reinforcement disposed centrally within the tarp, an opening disposed within the reinforcement, a plurality of spaced apart grommets disposed outwardly within the tarp, whereby each grommet is adapted to be attached to the pole.

9. The assembly of claim 1, including a vent aligned below said flagstaff and adapted to vent air through the canopy.

* * * * *